United States Patent [19]

Schneider et al.

[11] 4,229,936

[45] Oct. 28, 1980

[54] LOW-COST WATCH CASE AND BAND

[75] Inventors: Mark R. Schneider, San Jose; Larry D. Wickwar, San Mateo, both of Calif.

[73] Assignee: Fairchild Camera and Instrument Corporation, Mountain View, Calif.

[21] Appl. No.: 788,866

[22] Filed: Apr. 19, 1977

[51] Int. Cl.[2] ..... G04B 37/00; G04C 3/00

[52] U.S. Cl. ..... 368/282; 368/82; 368/280

[58] Field of Search ..... 58/23 R, 23 BA, 50 R, 58/88 R, 88 B, 88 C, 88 E, 88 G, 90 R, 90 B; 224/4 D, 4 E

[56] References Cited

U.S. PATENT DOCUMENTS

| | | | |
|---|---|---|---|
| 2,472,351 | 6/1949 | Tyler | 58/88 R |
| 2,714,284 | 8/1955 | Gazda | 58/80 |
| 3,492,809 | 2/1970 | Gisiger-Lusa | 58/88 R |
| 3,681,587 | 8/1972 | Brien | 240/2.1 |
| 3,838,568 | 10/1974 | Zurcher et al. | 58/88 C |
| 3,971,206 | 7/1976 | Martino | 58/88 R |
| 4,015,418 | 4/1977 | Rochat | 58/23 R |
| 4,023,347 | 5/1977 | Haber | 58/88 R |

FOREIGN PATENT DOCUMENTS

| | | | |
|---|---|---|---|
| 2621257 | 12/1976 | Fed. Rep. of Germany | 58/88 R |
| 2543157 | 3/1977 | Fed. Rep. of Germany | 58/23 BA |

*Primary Examiner*—Vit W. Miska
*Attorney, Agent, or Firm*—Paul J. Winters; Ronald J. Meetin; Michael J. Pollock

[57] ABSTRACT

A low-cost watch band and case comprises a receptacle for receiving a watch module, switch protuberances integrally formed with the sidewall of the receptale for actuating function switches on the watch module, and a watch band integrally formed with the receptacle for attaching to the user's arm.

8 Claims, 3 Drawing Figures

LOW-COST WATCH CASE AND BAND

BACKGROUND OF THE INVENTION

1. Field of the Invention

This invention relates to digital watches and more particularly to a watch case for digital watches.

2. Prior Art

Digital watches are now well known and are manufactured by numerous companies. Typically a digital watch comprises a socalled watch module containing an integrated circuit chip and a source of timing signals together with a display (typically light emitting diodes or a liquid crystal material) and one or more batteries. The module is mounted in a case which typically is fabricated of metal or plastic. Protruding through openings in the case is one or more function switches to allow the user to control the operation of the watch. One of the more expensive items in a digital watch is, surprisingly, the case. Not only is the case expensive, but the labor necessary to assemble the various components of the watch into the case to provide a finished watch is also expensive. Accordingly, the prices of digital watches reflect both the cost of the case and the labor of assembling the components with the case to provide a finished watch.

One problem which the watch industry has continuously faced is how to make a quality digital watch at a cost sufficient to allow the manufacturer to compete effectively in the marketplace. Technology to date has resulted in very little progress in this area in that all digital watches regardless of their manufacturer basically contain the same components so as to function in substantially the same manner.

SUMMARY OF THE INVENTION

This invention provides a novel approach to the structure of a digital watch which significantly reduces the cost of manufacture of a digital watch, provides a more reliable, less complicated watch case, substantially changes the nature of function switches required in digital watches and provides an improved water resistant casing for the module thereby resulting in a more reliable watch.

In accordance with this invention, a digital watch comprises a watch case formed integral with the watch band (hereinafter referred to as an "integral watch case-band" or for short, as a "watch case-band") wherein said watch case-band contains a cavity for receipt of a standard watch module with openings formed to the cavity through the back of the integral watch case-band for insertion and removal of batteries and a decorative front case inserted over the recess and portion of the watch case-band containing the module to provide the appearance of a standard digital watch. Alternatively, the integral watch case-band of this invention can either be sealed with no openings for batteries so that the watch can be thrown away when the batteries run out, or a regular snap-on back can be used.

The decorative front case can take a variety of forms and shapes such that the resulting digital watch will resemble any of a variety of accepted digital watch shapes. However, the integral watch case-band can take a standard form and shape, if desired, to significantly lower manufacturing costs and provide a uniformity of parts independent of the final appearance of the watch.

As a unique feature of the integral watch case-band, the function switches common in all digital watches manufactured prior to this invention have been completely eliminated and replaced by flexible portions of the watch case shaped to interact with the module switches necessary to control the functioning of the watch. Typically, these "integral buttons" comprise thicker portions of the sidewall of the watch case manufactured of a flexible resilient material capable of being easily moved by the user. The user determines the location of the integral buttons by feeling protuberances on the outside of the sidewall of the case opposite corresponding protuberances located on the inside of the case. The protuberances on the inside of the case are designed to interact with and actuate module switches on the watch module of the type disclosed in patent application Ser. No. 711,016, filed Aug. 9, 1976, now abandoned, on an invention of D. Duff et al. entitled "Structure and Method of Making a Low Cost Shock Resistant Watch", assigned to Fairchild Camera and Instrument Corporation, the assignee of this application.

DETAILED DESCRIPTION

Figure 1:
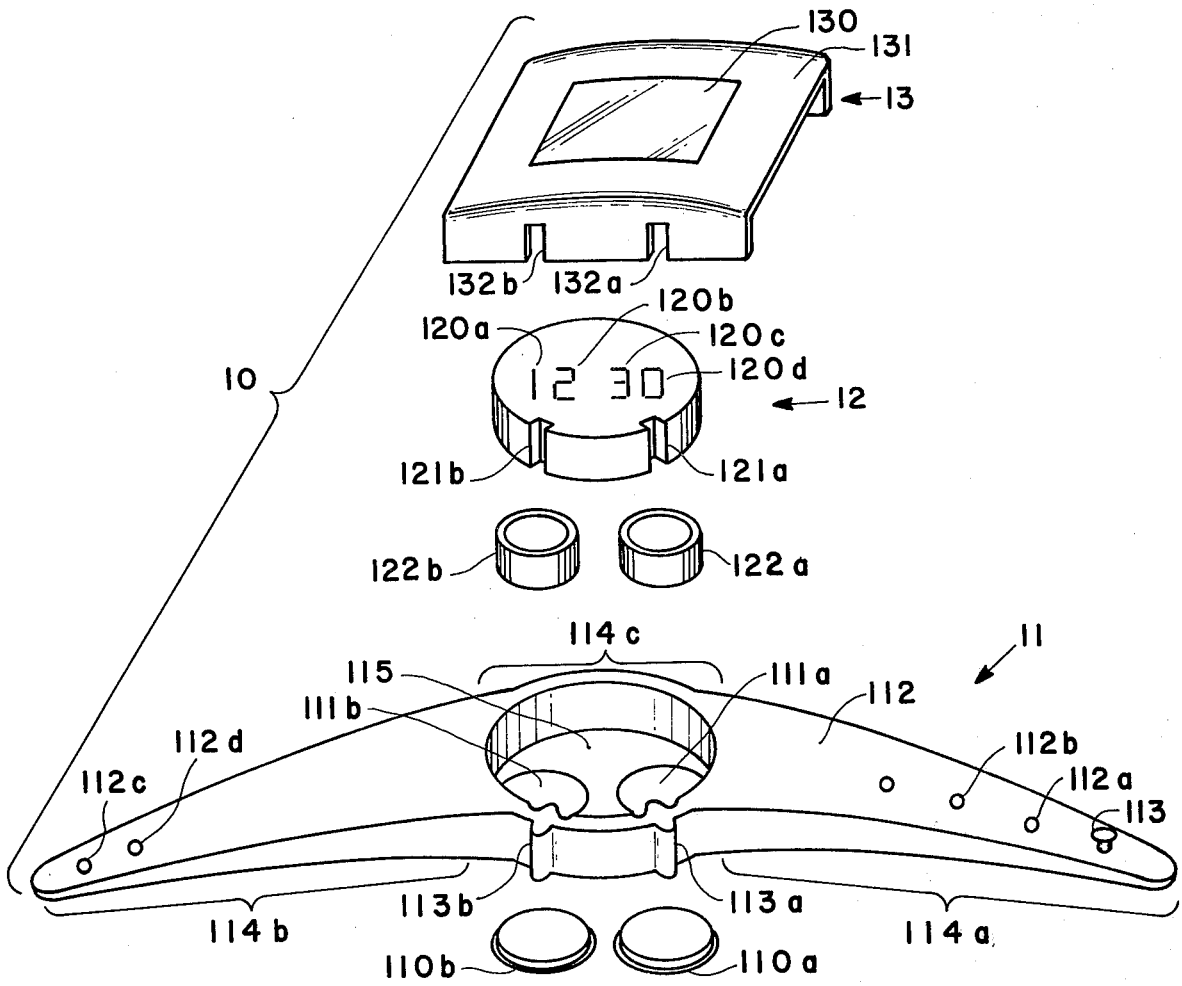
FIG. 1 shows an exploded view of the components of the integral watchband watch case structure of this invention.

An exploded view of the watch structure of this invention is shown in FIG. 1. Structure 11 comprises a composite watchband and watch case. Typically this structure is formed of a resilient plastic or rubber material formed into three sections. Sections 114*a* and 114*b* comprise the watchband portion 112 of the structure while section 114*c* contains a cavity 115 for receipt of a watch module. Formed in the bottom of cavity 115 are two openings— 111*a* and 111*b* through which batteries 122*a* and 122*b* can be removed from or inserted into the watch module 12. Hatchbacks 110*a* and 110*b* are provided for insertion into openings 111*a* and 111*b* respectively to close the openings 111*a* and 111*b* and provide water-resistant covers for the battery openings 111*a* and 111*b* in a manner described in copending application Ser. No. 754,212, filed Jan. 3, 1977, now abandoned, and in continuation application Ser. No. 896,836, filed Apr. 17, 1978, on an invention of L. Malloy et al. entitled "Snap-in Hatchback for Electronic Watches".

Module 12 comprises a standard watch module containing an integrated circuit, a source of timing signals such as a quartz crystal, function switches 121*a* and 121*b* integral to module 12 in a manner described in the above-referenced co-pending application Ser. No. 711,016 filed Aug. 9, 1976, now abandoned, and displays 120*a*, 120*b*, 120*c*, and 120*d* for displaying either the hours and the minutes, the seconds or the months and the days in accordance with signals received from the function switches 121*a* or 121*b*. A decorative front case 13 can then be inserted over the cavity portion of structure 11 so as to give to the assembled watch the desired appearance. While the decorative front case 13 shown in FIG. 1 has a substantially rectangular appearance, this front case 13 can assume any other appearance desired provided the internal dimensions of the front case 13 are such that it will properly fit over the cavity portion 114*c* of structure 11. Typically, the decorative front case 13 is merely press fit over recess portion 114*c* of structure 11. However, if desired, this decorative front case 13 can also be glued or otherwise sealed to or joined to the recess portion 114*c* of structure 11. Case 13 comprises a clear transparent window 130 of any desired shape, an opaque portion 131 which can have any color or appearance desired, and slots 132*a* and 132*b* to allow the user to actuate buttons 113*a* and 113*b* formed as an integral part of the sidewall of the recess 115 in the recess portion 114*c* of structure 11.

Figure 3:
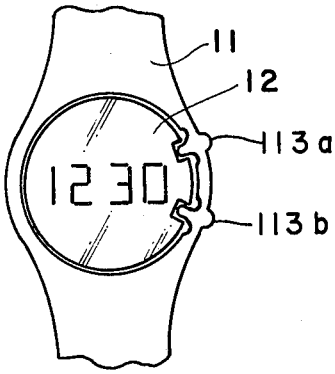
FIG. 3 shows the top view of the watch structure of this invention without the decorative case so as to particularly illustrate the integral molded push buttons necessary to control the operation of the watch.

Buttons 113*a* and 113*b* are formed of the same material as is the integral case and band 11. Typically the buttons 113*a* and 113*b*however, are shaped to be thicker than the normal sidewall of recess 115 so that the user can feel the location of the button 113*a* or 113*b* by feeling a protuberance on the sidewall. Opposite the external protuberance is an internal protuberance of the same material as the sidewall. FIG. 3 shows this construction in particular detail. This internal protuberance will then mate with the function switch 121*a* or 121*b* depending upon which integral button 113*a* or 113*b* is pushed, to activate the desired function switch 121*a* or 121*b* in module 12.

Figure 2:
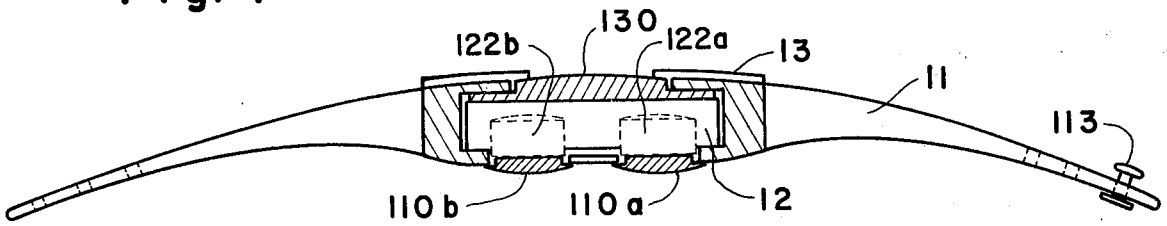
FIG. 2 shows a cross-sectional view of the watch structure of this invention.

The structure of this invention is shown in cross-sectional view fully assembled in FIG. 2. As shown in this structure, the hatchbacks 110*a* and 110*b* are properly located in their openings 111*a* and 111*b* in the backside of the recess 115 to firmly hold batteries 122*a* and 122*b* in position in module 12. Lens 130 is firmly in position over module 12. Typically lens 130 can be a red lens or a clear lens or of any other color desired. Placed over lens 130 is decorative front case 13. This front case 13 extends like a cover over the external surfaces of recessed portion 114*c* of integral case and band structure 11. Typically the front case 13 is force fit over recess portion 114*c* of structure 11.

A fastener 113 which may be of plastic or other type material is shown formed on one end of the band. Openings 112*a*, 112*b*, 112*c*, and 112*d* are provided for receipt of the fastener 113 to allow the user to fit the watch to his or her wrist. Although the fastener 113 is a standard type fastener used in the watch industry, other types of fasteners can be used with this watch including the standard buckle type fastener.

As will be apparent from the above description, the integral watch case-band structure of this invention together with the decorative front case structure provides a significant advantage over prior art structures. First, the cost of joining the watchband to the watch case is eliminated. Second, the structure is amenable to a fast and relatively inexpensive assembly operation. Third, the elimination of separate function switches removes a costly component and source of problems in digital watches and eliminates openings in the case which allow moisture and other impurities to interfere with the operation of the watch module. Finally, the integral watch case-band provides a standardized receptacle for the watch module together with the flexibility of varying the decorative front appearance of the watch by changing the type of front case placed over the cavity portion of the composite watch case-band.

The appearance of the band can be controlled by controlling the material of which the band is made or by controlling the texture of the mold to control the appearance of the watchband when it is taken from the mold. For example, the watchband can be a simulated leather material, or a variety of different type plastic type materials with any of the finishes that are available using these materials.

As shown in FIGS. 1 and 3, the thicker portions 113*a* and 113*b* of sidewall material forming the protuberances which replace the function switches or pins in the prior art watches, are joined to the adjacent sidewall material by a portion of the sidewall which is thinner in thickness than the normal thickness of the sidewall. This "necking down" of the sidewall material directly adjacent to these protuberances results in increased flexiblity of these protuberances relative to the remaining sidewall thereby reducing the force required to actuate the switches on the module.

One of the advantages of this invention is that the decorative front case (commonly known as a "bezel") can now be stamped and assembled with the integral watch case-band structure by an automated process thereby significantly reducing the cost of assembly of the digital watch. No longer does the case have to be hot-forged and machined in the manner in which such cases are now commonly formed.

What is claimed is:

1. An integral watch band and case comprising:

a receptacle for receiving a watch module, said receptacle having a sidewall formed of a resilient material, said sidewall having an outside surface and an inside surface;

switch means located directly adjacent to M switches operable for controlling functioning of the watch module, where M is a selected positive integer, said switch means comprising N sidewall sections integrally formed with said sidewall, where N is a selected positive integer, each of said N sidewall sections (1) being thicker than the normal thickness of said sidewall, (2) having an external protuberance extending outward beyond the normal outside surface of said sidewall, and (3) having an internal protuberance extending inward beyond the normal inside surface of said sidewall, each internal protuberance being located directly adjacent to at least one of said M switches, said switch means operable for actuating at least one of said M switches in response to the watch user pressing at least one of said N sidewall sections on said outside surface; and a watch band integrally formed with said receptacle for attaching said receptacle to an arm of the watch user.

2. An integral watch band and case as in claim 1 wherein at least one of said N sidewall sections is joined to said sidewall by at least one portion of said sidewall thinner than the normal thickness of said sidewall, thereby to reduce the force required to press said at least one sidewall section against at least one of said M switches.

3. An integral watch band and case comprising:

a receptacle for receiving a watch module, said receptacle having a sidewall formed of a resilient material;

switch means integrally formed with said sidewall and responsive to the watch user pressing said switch means for actuating at least one of N switches operable for controlling functioning of the watch module, where N is a selected positive integer, said switch means comprising N sidewall sections corresponding on a one-to-one basis to said N switches, each of said N sidewall sections (1) being thicker than the normal thickness of said sidewall, (2) having an external protuberance extending outward beyond the normal outside surface of said sidewall, and (3) having an internal protuberance opposite the external protuberance and extending inward beyond the normal inside surface of said sidewall, each internal protuberance being located directly adjacent to the corresponding switch; and a watch band integrally formed with said receptacle for attaching said receptacle to an arm of the watch user.

4. An integral watch band and case as in claim 3 wherein at least one of said N sidewall sections is joined to said sidewall by at least one portion of said sidewall thinner than the normal thickness of said sidewall, thereby to reduce the force required to press said switch means against at least one of said N switches.

5. An integral watch band and case as in claim 3 wherein N equals one.

6. An integral watch band and case as in claim 4 wherein N equals one.

7. An integral watch band and case as in claim 4 wherein said receptacle has a backside having at least one opening through said backside for allowing at least one battery to be inserted into or removed from the watch module.

8. An integral watch band and case as in claim 4 and further including a decorative front case formed over said receptacle for giving a desired appearance to said integral watch band and case.

* * * * *